US007639970B2

(12) United States Patent
Burry et al.

(10) Patent No.: US 7,639,970 B2
(45) Date of Patent: Dec. 29, 2009

(54) OPTIMIZATION OF MAGNETIC ROLL SPEED PROFILE IN AN ELECTROPHOTOGRAPHIC PRINTING SYSTEM

(75) Inventors: Aaron M. Burry, W. Henrietta, NY (US); Daniel M. Bray, Rochester, NY (US); Paul C. Julien, Webster, NY (US); Peter Paul, Webster, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 634 days.

(21) Appl. No.: 11/581,832

(22) Filed: Oct. 17, 2006

(65) Prior Publication Data

US 2008/0089717 A1 Apr. 17, 2008

(51) Int. Cl.
*G03G 15/08* (2006.01)

(52) U.S. Cl. ..... 399/236; 399/53; 399/55; 399/60

(58) Field of Classification Search ..... 399/53, 399/55, 60, 236
See application file for complete search history.

(56) References Cited

U.S. PATENT DOCUMENTS 4,371,257 A * 2/1983 Nishikawa ..... 399/53
6,167,226 A 12/2000 Matalevich et al.

* cited by examiner

*Primary Examiner*—David M Gray
*Assistant Examiner*—Ryan D Walsh
(74) *Attorney, Agent, or Firm*—Oliff & Berridge, PLC

(57) ABSTRACT

A control system for use with a development process including at least one magnetic roll with a settable speed is provided. The controller is directly or indirectly responsive to a reload feedback signal, which signal is generated in response to changes in output reload performance of the development process. In the case of direct responsiveness, the controller uses one or more reload feedback signals to facilitate magnetic roll speed setting. In the case of indirect responsiveness, the controller uses a reload sensitivity signal, which reload sensitivity signal varies as a function of input digital image content and output reload performance feedback, to facilitate magnetic roll speed setting.

28 Claims, 6 Drawing Sheets

OPTIMIZATION OF MAGNETIC ROLL SPEED PROFILE IN AN ELECTROPHOTOGRAPHIC PRINTING SYSTEM

RELATED APPLICATION

Cross-reference is made to the following co-pending, commonly assigned applications: U.S. patent application Ser. No. 11/090,727, filed on Mar. 25, 2005, by Julien et al., entitled "METHOD AND SYSTEM FOR REDUCING TONER ABUSE IN DEVELOPMENT SYSTEMS OF ELECTROPHOTOGRAPHIC SYSTEMS;" and U.S. patent application Ser. No. 11/172,301 filed on Jun. 30, 2005, by Burry et al., entitled "FEED FORWARD MITIGATION OF DEVELOPMENT TRANSIENTS."

BACKGROUND

The disclosed embodiments relate generally to electrophotographic printing machines and more particularly to improvements for development systems in electrophotographic printing machines. Generally, the process of electrophotographic printing includes charging a photoconductive member to a substantially uniform potential to sensitize its surface. The charged portion of the photoconductive surface is exposed to a light image from a scanning laser beam or an LED source that corresponds to an original document being reproduced. The effect of the light on the charged surface produces an electrostatic latent image on the photoconductive surface. After the electrostatic latent image is recorded on the photoconductive surface, the latent image is developed. Two-component and single-component developer materials are commonly used for development. A typical two-component developer comprises a mixture of magnetic carrier granules and toner particles. A single-component developer material is typically comprised of toner particles without carrier particles. Toner particles are attracted to the latent image, forming a toner powder image on the latent image of the photoconductive surface. The toner powder image is subsequently transferred to a copy sheet. Finally, the toner powder image is heated to permanently fuse it to the copy sheet to form the hard copy image.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are halftone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developability and electrostatics. Electrostatic voltages are measured using a sensor such as an ElectroStatic Voltmeter (ESV). Developability is a measure of the amount of development (toner mass/area) that takes place under a given set of electrostatic conditions. The developability is usually a function of the toner concentration in the developer housing as well as other toner state parameters, such as adhesion. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring TC in the developer housing. However, the relationship between TC and developability is affected by other variables, such as ambient temperature, humidity and the age of the toner.

One common type of development system uses one or more donor rolls to convey toner to the latent image on the photoconductive member. A donor roll is loaded with toner either from a two-component mixture of toner and carrier particles or from a single-component supply of toner. The toner is charged either from its triboelectric interaction with carrier beads or from suitable charging devices, such as frictional or biased blades or from other charging devices. As the donor roll rotates it carries toner from the loading zone to the latent image on the photoconductive member. There, suitable electric fields can be applied with a combination of DC and AC biases to the donor roll to cause the toner to develop to the latent image. Additional electrodes, such as those used in the Hybrid Scavengeless Development (HSD) technology may also be employed to excite the toner into a cloud from which it can be harvested more easily by the latent image. The process of conveying toner to the latent image on the photoreceptor is known as development.

A problem with donor roll developer systems is a defect known as ghosting or reload which appears as a lightened ghost image of a previously developed image in a halftone or solid on a print. The reload defect occurs when insufficient toner has been loaded onto the donor roll within one revolution of the donor roll after an image has been printed. In this situation, there will be a localized region of the donor roll that is not fully loaded with toner (it has been depleted of toner mass by the previous image). The donor roll thus retains the memory of the previous image, and a ghost of the previous image shows up if another image is printed at that time.

The susceptibility of the development system to a reload defect is dependent upon the image content of a print job (how much toner was removed from the donor roll by the image areas of the previous image, as well as the exact requirements of the present image) as well as the rate at which toner is reloaded onto the donor rolls (the maximum rate at which toner can be re-supplied to the donors). One way of improving the ability of the toner supply to provide an adequate amount of toner to reduce or prevent ghost images is to increase the peripheral speed of the magnetic brush or roll that transfers toner from the supply reservoir to the donor roll. However, as the relative difference in the speeds of the magnetic brush and donor rolls increases so do the collisions of the carrier or toner granules. The toner particles also impinge on the blade mounted proximate to the magnetic brush to regulate or trim the height of the magnetic brush so that a controlled amount of toner is transported to the developer roll. The collisions of the toner with the carrier and the trim blade tend to smooth the surface of the toner particles and cause the particles to exhibit increased adhesion.

In general, the surface of the carrier particles can be affected by these collisions (with other carriers, trim bars, etc) as well. This general process is sometimes referred to as material abuse. The increased adhesion of the toner particles that have experienced a great deal of abuse causes less toner to be transferred to the photoreceptor to develop the latent image for a given development voltage. Thus, there is a tradeoff between increased speed of the magnetic brush to improve reload performance and the rate of material abuse. In most development systems, the tradeoff between increased toner supply and material abuse is made at design time. Typically the speed of the magnetic brush or roll is selected such that a solid patch can be developed within one donor revolution of another solid patch with minimal reload effects being observable in the developed mass image.

Material abuse is a problem for many development systems when printing low area cover (LAC) jobs. For LAC print jobs, there is little toner throughput and so the average age of the material in the developer sump can increase substantially. One potential problem as the age of the material in the sump increases is that the level of abuse that a given toner or carrier particle has experienced can actually become quite high. When this occurs, the developability of the toner particles generally tends to decrease, which then leads to a degradation in the performance of the development subsystem. In some circumstances, increased toner age and the associated increases in material abuse can also lead to problems in the transfer subsystem as well. Eventually these effects can lead to substantial print quality problems that may require costly mitigation strategies.

One approach for controlling the rate of material abuse in the developer housing is to maintain some constant level of abuse of the material independent of the image content that is being printed. This can be accomplished by adjusting how much energy is input to the developer housing based on the current image content of the customer's print job.

U.S. patent application Ser. No. 11/090,727 (filed by Julien et al. on Mar. 25, 2005), the pertinent portions of which are incorporated herein by reference, employs an approach in which the speed of the magnetic roll is adjusted on-the-fly based on image content to reduce material abuse. A possible difficulty with reducing the speed of the magnetic roll is in the occurrence of the reload defect. To minimize the occurrence of this defect, the '727 patent Application proposes the use of a reload sensitivity detection algorithm to determine which pages within a customer's job are candidates for speed reduction without the possibility of inducing reload defects. Using this feed-forward information, the controller can then appropriately adjust the speed of the magnetic roll while attempting to minimize the chance for inducing reload defects in the output prints.

That is, the speed of the magnetic roll $\omega(k)$ is chosen based on an estimated reload sensitivity metric $M_{reload}(k)$:

$$\omega_{mag}(k)=f_c[M_{reload}(k)]$$

where $f_c(\,)$ is a function representing the magnetic roll speed control algorithm and the reload sensitivity metric $M_{reload}(\,)$ is calculated based on the image content I(k) of page k as follows:

$$M_{reload}(k)=f_{reload}[I(k)]$$

where $f_{reload}(\,)$ is a function representing the algorithm for predicting reload sensitivity based on the image content of page k. Disclosure regarding algorithms for predicting reload sensitivity based on the image content of a document is provided in U.S. patent application Ser. No. 10/998,098 (filed by Klassen et al. on Nov. 24, 2004, and published on May 25, 2006 (publication number 20060109487)), the pertinent portions of which are incorporated herein by reference.

A simple controller algorithm for determining the desired magnetic roll speed based upon the estimated reload sensitivity metric for a given page may be described as follows:

$$\omega_{mag}(k)=K_{ff}M_{reload}(k)$$

Here $K_{ff}$ is meant to be a simple feedforward gain that can be adjusted as part of the initial design process. This controller example follows the approach that is typical of previous methods: utilizing a controller design that only comprehends a static relationship between image content and desired magnetic roll speed (pure feedforward with no feedback information being used to adjust the controller output).

The problem with this type of purely feed-forward approach is that the latitude in system performance (the latitude representing how unlikely it is to have a reload defect during a customer's print job) is achieved by choosing static controller parameters that guarantee reload-free printing under a broad range of operating conditions. An example of the problem with this type of approach is that the sensitivity of the development system to the reload defect is known to vary with the age of the developer material. More specifically the age of the carrier is known to relate to a change in the conductivity of the material.

Since it is well known that the conductivity of the material will affect reload performance (for example conductivity is the mechanism whereby changes to the AC portion of the mag-donor voltage, $V_{dmac}$, are known to affect reload performance in an HSD developer housing), it follows that the reload performance for a given image content is not a fixed relationship. As the state of the material changes (its age and conductivity will change with time, particularly during LAC print jobs), the amount of reload that will occur for a given image content will change as well. A variety of other noise factors could affect the relationship between desired image content and the susceptibility to the reload defect as well. In order to account for these noise factors, previous magnetic roll speed control methods have simply chosen controller parameters that provide acceptable performance over a broad range of operational variation. Such parameter selections are thus, by design, less than optimal choices for various operating conditions.

By not accounting for these expected changes in reload performance over time, various prior magnetic roll speed control methods merely seek to obtain an acceptable static relationship between input image content and desired magnetic roll speed over a generalized range of operating conditions. Even the approach proposed by U.S. patent application Ser. No. 11/172,301 (filed by Burry et al. on Jun. 30, 2005), the pertinent portions of which are incorporated herein by reference, does not exploit dynamic information based on reload performance to optimize speed choices based on operating condition. Rather the approach of the '301 patent Application permits the adjustment of controller parameters relating to solid area development mass per unit area (DMA) to eliminate unwanted shifts in DMA each time the speed of the magnetic roll is varied. Thus, it would be desirable to provide an approach using feedback information regarding reload performance to adjust controller output (magnetic roll speed) for a given input image content.

SUMMARY OF DISCLOSED EMBODIMENTS

In accordance with the disclosed embodiments, there is provided a control system for use with a development process including at least one magnetic roll with a settable speed. Pursuant to operation, the development process outputs a reload performance signal. The control system includes: a controller, responsive to a reload sensitivity signal, for controlling the speed of the at least one magnetic roll; an image analyzing system, communicating with said controller, for transmitting the reload sensitivity signal to said controller; a reload defect detection system communicating with an output of the development process, said reload detection system generating a reload feedback signal in response to changes in output reload performance of the development process, wherein the reload sensitivity signal is adjusted dynamically with the reload feedback signal; and wherein said controller causes the speed of the at least one magnetic roll to be set with the dynamically adjusted reload sensitivity signal.

In accordance with another aspect of the disclosed embodiments, there is provided a control system for use with a development process including at least one magnetic roll with a settable speed. Pursuant to operation, the development process receives a speed control related signal and outputs a reload performance signal. The control system includes: a controller for controlling the speed of the at least one magnetic roll; a reload detection system communicating with said controller, said reload detection system generating a set of one or more reload feedback signals responsive to changes in output reload performance of the development process; and wherein the controller, responsive to the set of one or more reload feedback signals, dynamically adjusts the mapping between the reload metric and the output speed control related signal for causing the speed of the at least one magnetic roll to be set.

BRIEF DESCRIPTION OF THE DRAWINGS

By way of example, disclosed embodiments will be described with reference to the accompanying drawings, in which.

DESCRIPTION OF DISCLOSED EMBODIMENTS

Figure 1:
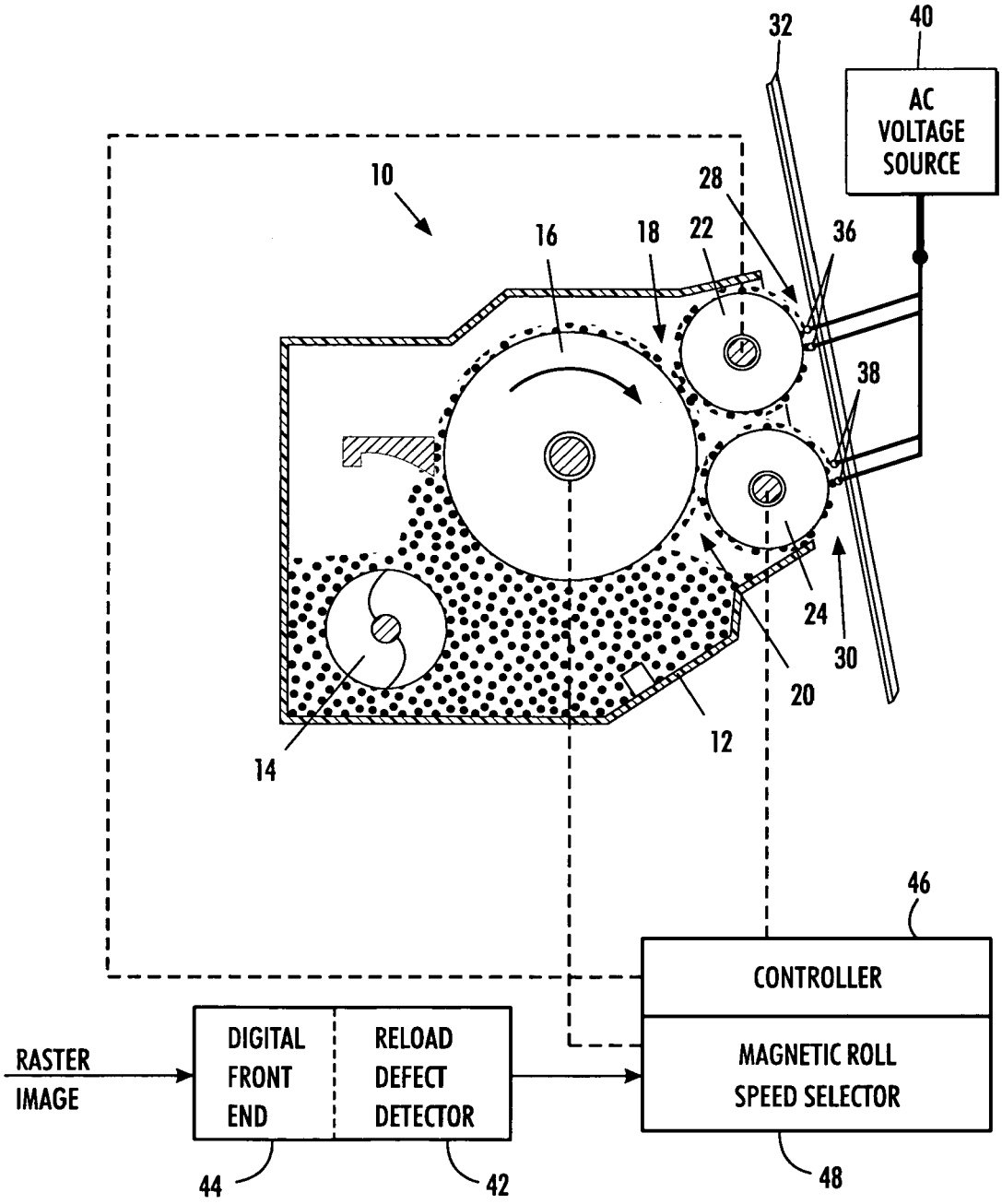
FIG. 1 is a schematic elevational view of a development system suited for use in a printing system.

The disclosed embodiments relate to a system and method for dynamically controlling magnetic roll speed in a development apparatus. The development apparatus may be put to effective use in monochrome or color printing systems of the types found in, for example, U.S. Pat. No. 6,167,226 to Matalevich and U.S. Pat. No. 6,665,510 to Hirsch, the pertinent portions of which patents are incorporated herein by reference. Referring to FIG. 1, the details of a development apparatus, suitable for use in a color printing system, are shown.

The development apparatus, designated with the numeral 10, comprises a reservoir 12 containing developer material. The developer material is of the two component type in that such material comprises carrier granules and toner particles. The reservoir includes augers, indicated at 14, which are rotatably-mounted in the reservoir chamber. The augers 14 serve to transport and agitate the material within the reservoir, thus encouraging the toner particles to charge triboelectrically and adhere to the carrier granules. A magnetic brush roll 16 transports developer material from the reservoir to the loading nips 18, 20 of two donor rolls 22, 24.

Magnetic brush rolls are well known, so the construction of roll 16 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 16 rotate, the granules (with toner particles adhering triboelectrically thereto) are attracted to the roll 16 and conveyed to the donor roll loading nips 18, 20. A metering blade (not shown) removes excess developer material from the magnetic brush roll and ensures an even depth of coverage with developer material before arrival at the first donor roll loading nip 18. At each of the donor roll loading nips 18, 20, toner particles are transferred from the magnetic brush roll 16 to the donor rolls 22, 24.

Each donor roll transports the toner to a respective development zone 28, 30 through which a photoconductive belt 32 passes. Transfer of toner from the magnetic brush roll 16 to the donor rolls 22, 24 can be facilitated by, for example, the application of a suitable D.C. (and/or A.C.) electrical bias to the magnetic brush and/or donor rolls. The D.C. bias (for example, approximately 70 V applied to the magnetic roll) establishes an electrostatic field between the donor roll and magnetic brush rolls, which field causes toner particles to be attracted to the donor roll from the carrier granules on the magnetic roll.

The carrier granules and any toner particles that remain on the magnetic brush roll 16 are returned to the reservoir 12 as the magnetic brush continues to rotate. The relative amounts of toner transferred from the magnetic brush roll 16 to the donor rolls 22, 24 can be adjusted, for example by: applying different bias voltages to the donor rolls; adjusting the magnetic brush to donor roll spacing; adjusting the strength and shape of the magnetic field at the loading nips and/or adjusting the relative speeds between the donor rolls and the magnetic roll.

At each of the development zones 28, 30, toner is transferred from the respective donor rolls 22, 24 to the latent image on the belt 32 to form a toner powder image on the latter. Various methods of achieving an adequate transfer of toner from a donor roll to a photoconductive surface are known and any of those may be employed at the development zones 28, 30.

In FIG. 1, each of the development zones 28, 30 is shown as having a form i.e. electrode wires disposed in the space between donor rolls 22, 24 and photoconductive belt 32. For each donor roll 22, 24, a respective pair of electrode wires 36, 38 extending in a direction substantially parallel to the longitudinal axis of the donor roll. The electrode wires are made from thin (i.e. 50 to 100 micron diameter) stainless steel wires which are closely spaced from the respective donor roll. The wires are self-spaced from the donor rolls by the thickness of the toner on the donor rolls. The distance between each wire and the respective donor roll is within the range from about 5 microns to about 20 microns (typically about 10 microns) or the thickness of the toner layer on the donor roll. An alternating electrical bias is applied to the electrode wires by an AC voltage source 40.

The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 32. The magnitude of the AC voltage in the order of 200 to 500 volts peak at frequency ranging from about 8 kHz to about 16 kHz. A DC bias supply (not shown) applied to donor rolls 22, 24 establishes electrostatic fields between the photoconductive belt 32 and donor rolls for attracting the detached toner particles from the clouds surrounding the wires to the latent image recorded on the photoconductive surface of the belt 32.

As successive electrostatic latent images are developed, the toner particles within the developer material are depleted. A toner dispenser (not shown) stores a supply of toner particles. The toner dispenser is in communication with reservoir 12 and, as the concentration of toner particles in the developer material is decreased, fresh toner particles are furnished to the developer material in the reservoir. The auger 14 in the reservoir chamber mixes the fresh toner particles with the remaining developer material so that the resultant developer material therein is substantially uniform with the concentration of toner particles being optimized. In this way, a substantially constant amount of toner particles is in the reservoir. The two-component developer used in the apparatus of FIG. 1 may be of any suitable type. However, the use of an electrically conductive developer is preferred because it eliminates the possibility of charge build-up within the developer material on the magnetic brush roll which, in turn, could adversely affect development at the second donor roll.

At each of the development zones 28, 30, toner is transferred from the respective donor rolls 22, 24 to the latent image on the belt 32 to form a toner powder image on the latter. Various methods of achieving an adequate transfer of toner from a donor roll to a photoconductive surface are known and any of those may be employed at the development zones 28, 30.

As is known, the control system on the "front end" of a printing system is often referred to as a digital front end (DFE). As will appear, the disclosed embodiments exploit information regarding reload defects to control the magnetic roll speed in the development apparatus 10. Commercially available DFEs for electrophotographic machines have the ability to generate low resolution images that may be used for reload sensitivity evaluation. Further detailed description of the reload defect sensitivity detector may be obtained from the above-referenced U.S. patent application Ser. No. 11/090,727.

Referring still to FIG. 1, a reload defect sensitivity detector for generating a signal corresponding to a predicted potential for the occurrence of a reload defect in an image to be developed by an electrophotographic system is designated with the numeral 42. The reload defect sensitivity detector may be part of a DFE, designated by the numeral 44, the DFE receiving a reduced or full size raster scanned image for reload potential evaluation. As should be appreciated, the reload defect sensitivity detector need not detect the magnitude of a reload "defect," but rather could detect a quantity related to the occurrence of a defect (for instance, a direct measurement of the reloading efficiency on the donor). Hence the detector 42 might use feedback of "reload" performance, but not necessarily of the reload "defect" itself. The DFE 44 may include one or more software modules to implement the reload defect sensitivity detector 42. Alternatively, the reload defect sensitivity detector 42 may be included in a software library associated with a development controller 46 or it may be implemented as a stand alone component interposed between a magnetic roll speed selector 48 and the DFE 44.

The reload defect sensitivity detector 42 operates to compare the geometry and coverage of source and destination areas approximately one donor roll distance apart to determine whether a reload defect is possible, and possibly to what extent the defect may occur. This analysis can be done at various granularities. For instance, it is possible to generate a reload sensitivity for each page in a customer's document. Alternatively, multiple pages could be grouped together in the analysis such that fewer output sensitivity samples were generated. In an electrophotographic system having two donor rolls, the reload defect detector evaluates source and destination areas of the scan image at a donor roll distance corresponding to each donor roll. The donor roll distances vary from one another because of variations in the rotational speeds of the two donor rolls. In one example, the reload defect detector 42 can generate a signal to the magnetic roll speed selector 48 that indicates whether or not a reload defect is likely to occur on a page corresponding to a latent image to be developed by the development system. In a two donor roll system, the reload defect detector 42 may generate a signal indicating a reload defect is likely in response to a reload defect evaluation at either donor roll. Alternatively, the signal may be one that indicates the expected magnitude of reload defect that will occur. This more continuous measure of the reload sensitivity may reflect the likelihood that a reload defect, though produced by the electrophotographic system, may not be severe enough to be visible to a user. For example, if the image causing a reload defect is rendered with a light tint or has little spatial extent, the amount of toner involved may be so small that the defect is not visible. Another alternative is that the signal be a vector of values that represents the predicted reload magnitude at various magnetic roll speed settings.

The magnetic roll speed selector 48 (FIG. 1) selects a rotational speed for a magnetic roll in the improved development system, potentially on a page-by-page basis. The magnetic roll speed selector 48 may be implemented with one or more software modules in the controller 46. Alternatively, the magnetic roll speed selector may be comprised of software components or hardware components of the DFE 44 or it may be implemented as a stand alone component interposed between the reload defect detector 42 and the DFE 44. In response to the signal from the reload defect detector 42, the magnetic roll speed selector adjusts the speed signal to the magnetic brush roll 16. As will appear, in one contemplated embodiment the speed of the roll 16 may be selected from a range of possible speeds.

The signal generated by the reload defect detector 42 may take a variety of forms. For example, the reload defect detector may generate an analog signal indicative of an expected reload defect potential in the image to be developed by the electrophotographic system. The voltage of the signal may indicate the likelihood or the expected magnitude of a reload defect that will occur from developing an image. Alternatively, the reload defect detector may generate a digital signal that indicates a reload defect potential in the image to be developed by the electrophotographic system. The digital signal may be a binary signal or a digital value that is indicative of a likelihood or of a predicted magnitude for the reload defect. The binary signal indicates whether a reload defect is likely to occur or not. The digital value is a multi-bit data word that may be used to quantify the potential or possibly the expected magnitude for the reload defect. The greater the digital value, the higher the speed at which the magnetic roll is driven to ensure acceptable reload performance in the output prints.

The magnetic roll speed selector 48 may generate a current signal corresponding to a rotational speed magnitude. This current signal may be provided to the motor drive for the magnetic brush roll 16. The greater the magnitude of the current, the higher the speed at which the magnetic roll is driven. The magnetic roll speed selector may alternatively generate an analog signal, the voltage of which corresponds to a desired rotational speed magnitude. That is, the voltage for the generated signal may be a control signal for the low-level magnetic roll speed controller. The magnetic roll speed controller would then be responsible for performing the necessary actions to maintain the desired speed of the magnetic roll based on the given input signal. Alternative implementations could involve serial or other communications protocols being used to transmit the desired speed from the magnetic roll speed selector 48 to the low-level motor drive controller for the magnetic roll.

The magnetic roll speed selector 48 may generate a digital signal corresponding to a rotational speed magnitude for the magnetic roll. The digital signal may be a binary signal or a digital value. When the digital signal is a binary signal, the state of the signal determines whether the magnetic roll is driven at a high speed or a low speed. In one embodiment, the low speed for the magnetic roll is 317 mm/second and the high speed is 1268 mm/second, although other speeds may be selected. Preferably, the low speed, which is selected in response to the reload defect not being likely, is approximately 25% of the high speed that is used to attenuate or prevent reload defects for substantially all input image content.

When the magnetic roll of a development system is operated at a low speed that is approximately 25% of the high speed used to counteract reload defects, the operational life of the development system may be extended considerably. A magnetic roll speed selector 48 that generates a digital value may generate a value corresponding with a magnetic roll speed in a predetermined range of magnetic roll speeds. In this embodiment, the speed signal may be used to adjust the speed of the magnetic roll in a way that accounts for the magnitude of the reload defect, the number of potential reload defects per page, the predicted objectionability of the expected reload occurrences, or the like. That is, the speed of the magnetic roll may be controlled in such a way as to address the reload defect that is determined likely to occur (as opposed to the worst case scenario anticipated by the high magnetic roll speed). This worst case scenario may occur when a solid area is followed by a midlevel halftone separated from the original solid area by the equivalent of one donor roll revolution.

Figure 2:
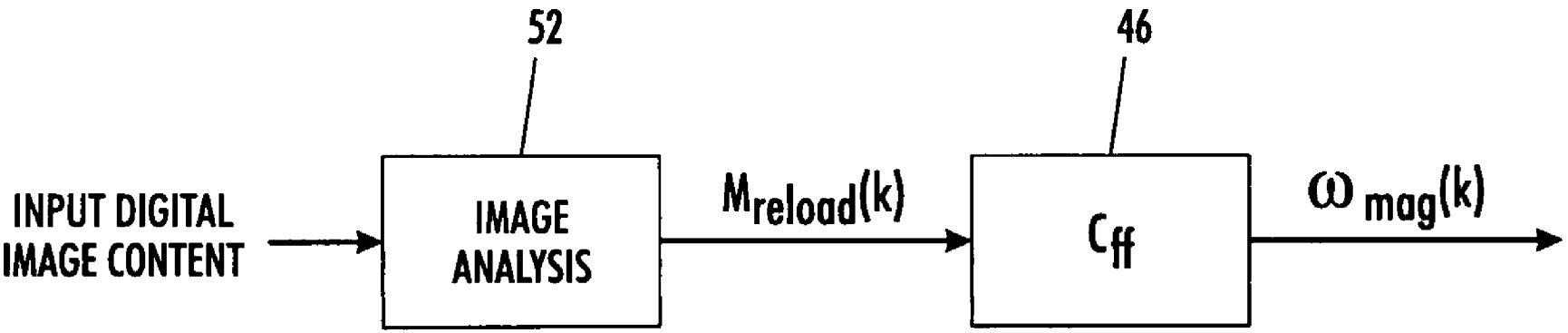
FIG. 2 is a block diagram of a two step mapping from image content to desired magnetic roll speed, the corresponding magnetic roll be operatively associated with a development system of the type shown in FIG. 1.

An improved approach for operating the development system 10 is shown in FIGS. 2-6. Referring first to FIG. 2, a mapping between image content and magnetic roll speed is shown. As disclosed herein, that mapping can be achieved in a dynamic manner. That is, measurements of output reload performance at a desired sampling interval can be made with the system of FIG. 1, and corresponding reload feedback information can then be used to adjust the mapping between image content and desired speed that is used by the controller 46 (FIGS. 1 and 2). It has been found that there are at least two ways to make the image content/magnetic roll speed mapping dynamic.

Figure 3:
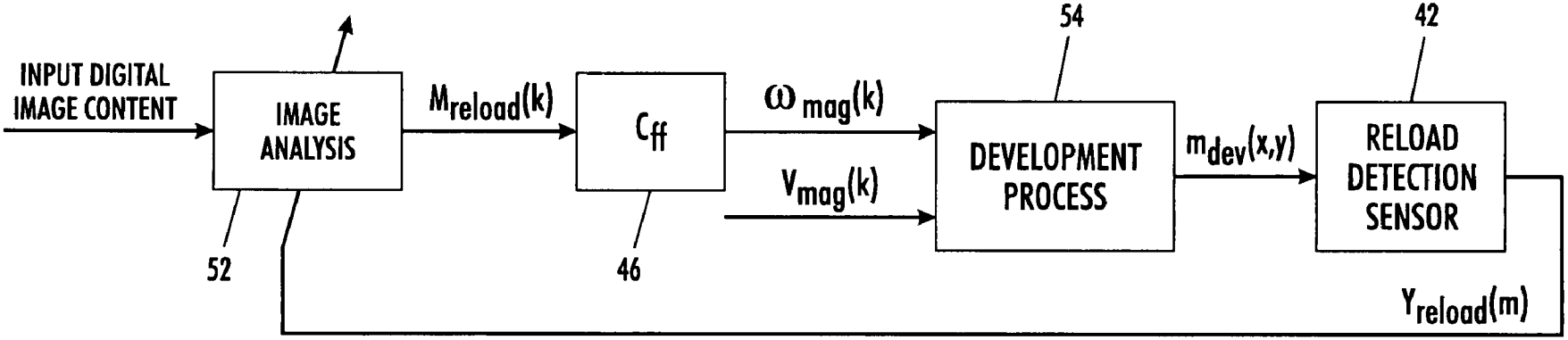
FIG. 3 is a block diagram of a control system for a development system (of the type shown in FIG. 1) with adaptive reload metric.

Referring to FIG. 3, a first way of making image content/magnetic roll speed mapping dynamic is illustrated. As shown, an image analysis system 52 communicates with the feed forward controller 46, the image analysis outputting an estimated reload sensitivity signal $M_{reload}(k)$. The controller 46 operates cooperatively with a development process 54, the development process receiving a magnetic roll speed control signal $\omega_{mag}(k)$ and a voltage setpoint ($V_{Mag}(k)$). In the first way, it is contemplated that $M_{reload}(k)$ is mapped to one of a plurality of a values, the values corresponding with $\omega_{mag}(k)$. As will be understood, this mapping could be achieved with one of several approaches. In one approach, for instance, $M_{reload}(k)$ would be mapped to $\omega_{mag}^{(1)}$ when $M_{reload}(k)$ is less than a selected threshold and $M_{reload}(k)$ would be mapped to $\omega_{mag}^{(2)}$ when $M_{reload}(k)$ is greater than the selected threshold. In another approach, values of $M_{reload}(k)$ would be mapped to a substantial range of values. This could be achieved, in one example, by corresponding a contemplated number of values for $M_{reload}(k)$ with a contemplated number of values for $\omega_{mag}(k)$ in a suitable look-up table.

Referring still to FIG. 3, samples of output reload performance from the development process, corresponding with $m_{dev}(x,y)$, are detected with the reload detection sensor 42, and a reload defect feedback signal is provided to the image analysis system 52, via $Y_{reload}(m)$. As contemplated by the disclosed embodiments, an algorithm in the image analysis system is used to generate the $M_{reload}(k)$ signal or metric. In one example, the algorithm for calculating this metric is written as a function of both the image content of the present page (I(k)) and also of the last sample of the output reload performance $Y_{reload}(m)$ as follows:

$$M_{reload}(k)=f[I(k),Y_{reload}(m)] \quad (1)$$

As contemplated, the algorithm would use the reload defect feedback function to suitably modify the algorithm disclosed by the above-mentioned '098 patent Application. In this way, the result of the algorithm of the '098 patent Application would vary not only as a function of input digital image content, but as a function of output load performance.

Figure 4:
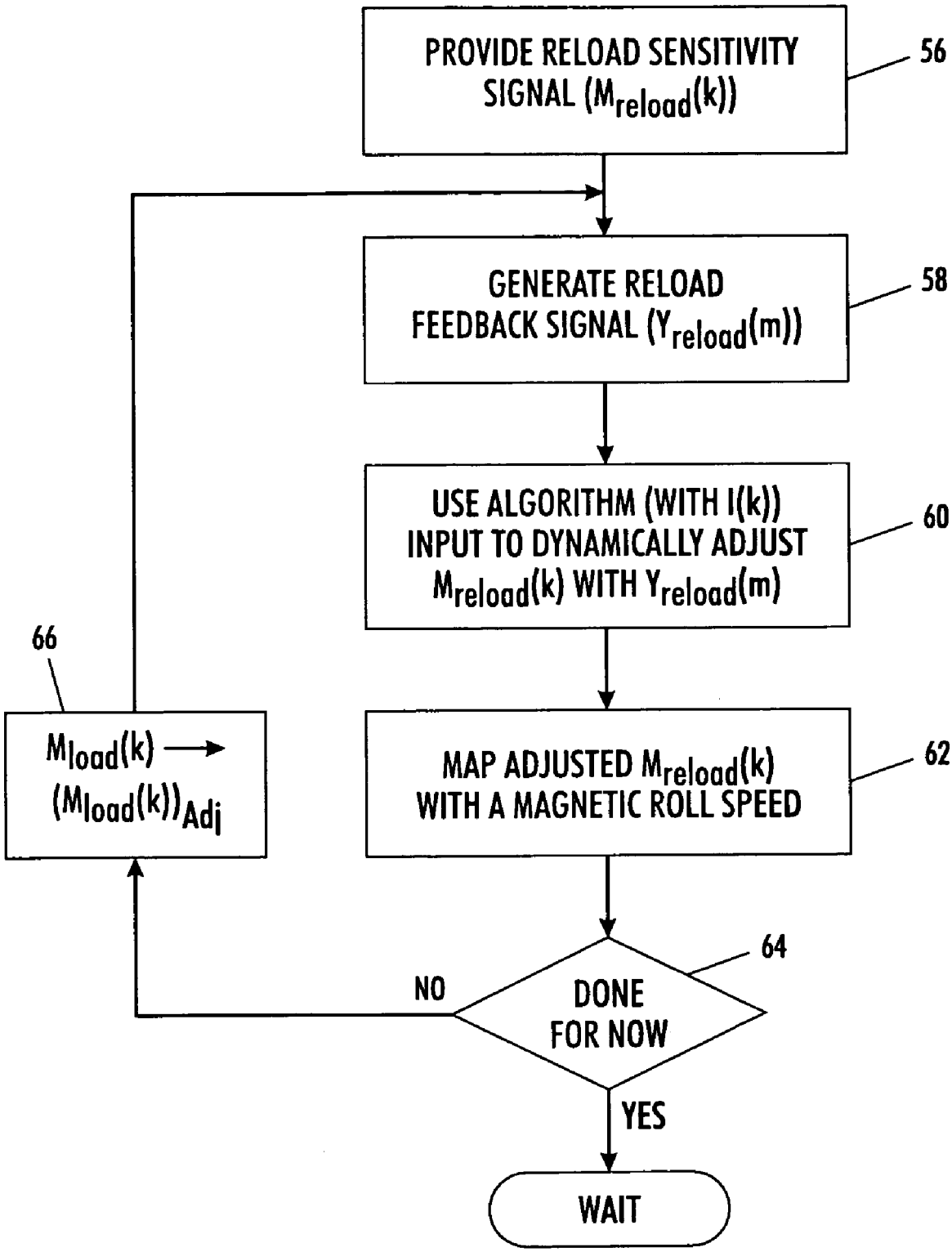
FIG. 4 is a flow diagram illustrating an exemplary methodology suitable for use with the control system of FIG. 3.

Referring to FIG. 4, an exemplary methodology for use with the implementation of FIG. 3 is shown. Initially, at 56, the reload sensitivity signal ($M_{reload}(k)$), developed with the image analysis system 52 (FIG. 3), is provided for input to the controller 46. In turn, $M_{reload}(k)$ is used, along with $V_{Mag}(k)$, to control magnetic roll speed ($\omega_{mag}(k)$). As samples of output reload performance are obtained from the development process 54 and detected with reload detection sensor 42, a reload defect feedback signal ($Y_{reload}(m)$), at 58, is generated. At 60, the above-mentioned algorithm of image analysis system 52, with I(k) and $Y_{reload}(m)$ as inputs, is used to dynamically adjust $M_{reload}(m)$. The dynamically adjusted $M_{reload}(k)$ is then used, at 62 to select an appropriate magnetic roll speed $\omega_{mag}(k)$. A check is performed at 64 to determine if further adjustment of $M_{reload}(m)$ is desired. As discussed below, $Y_{reload}(m)$ will not generally require constant update, and consequently, in a number of situations, the process will be able to wait for a selected time before generating a new reload defect feedback signal. Assuming immediate update for feedback of output reload performance is desired, the current adjusted $M_{reload}(k)$ (66) is fed back to 58 for repetition of the process.

Figure 5:
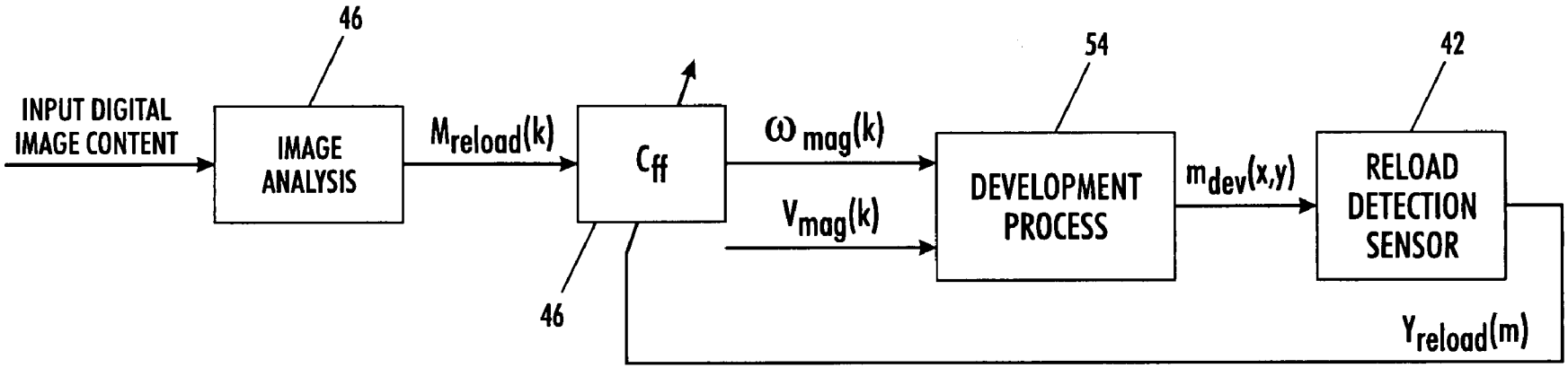
FIG. 5 is a block diagram of a control system for a development system (of the type shown in FIG. 1) with adaptive controller parameters.

Referring to FIG. 5, a second way of making image content/mag speed mapping dynamic is illustrated. In this second way, the algorithm of the controller 46 itself (i.e., the algorithm used to generate $\omega_{mag}(k)$) exploits the feedback of the output reload performance ($Y_{reload}(m)$). In one example, this might be accomplished by including an adjustable gain on the estimated reload sensitivity metric that is based upon prior feedback measurements of the actual reload performance. The algorithm, in this example, assumes the following form:

$$\omega_{mag}(k)=K_{ff}[Y_{reload}(m)]M_{reload}(k) \quad (2)$$

In equation (2) the feed-forward gain $K_{ff}(\ )$ on the reload metric is not constant, but rather is a function of the most recent sample m of the output reload performance [$Y_{reload}(m)$].

For the above described ways of FIGS. 3 and 5 it is not necessary to limit the feedback path (between the reload detection sensor 42 and image analysis system 52/controller 46) to the single, most recent measurement of the reload performance. Rather, both ways can be generalized such that one or more samples with individual weights could be employed in the design of the algorithm for adjusting the parameters of the image analysis system and/or the controller.

As an illustrative example, the functional relationship of (1) could be extended to include more samples of the reload performance as follows:

$$M_{reload}(k)=f[I(k),\alpha_0 Y_{reload}(m),\alpha_1 Y_{reload}(m-1),\ldots,\alpha_{N-1} Y_{reload}(m-N-1)] \quad (3)$$

where N refers to the number of reload performance samples included in the calculation and the m coefficients enable adjustment of the contribution of each of these samples.

The functional mapping between the feedforward gain $K_{ff}$ and the actual reload performance $Y_{reload}$ in (2) might be of the following form:

$$K_{ff}=f(Y_{reload}(m)) \quad (4)$$

This relationship could be extended to include multiple samples of the reload performance by way of the following expression:

$$K_{ff}=f(\alpha_0 Y_{reload}(m),\alpha_1 Y_{reload}(m-1),\ldots,\alpha_{N-1} Y_{reload}(m-N-1)) \quad (5)$$

where N again refers to the number of reload samples that are included in the calculation and the $\alpha_i$ coefficients enable adjustment of the contribution of each of these samples.

Figure 6:
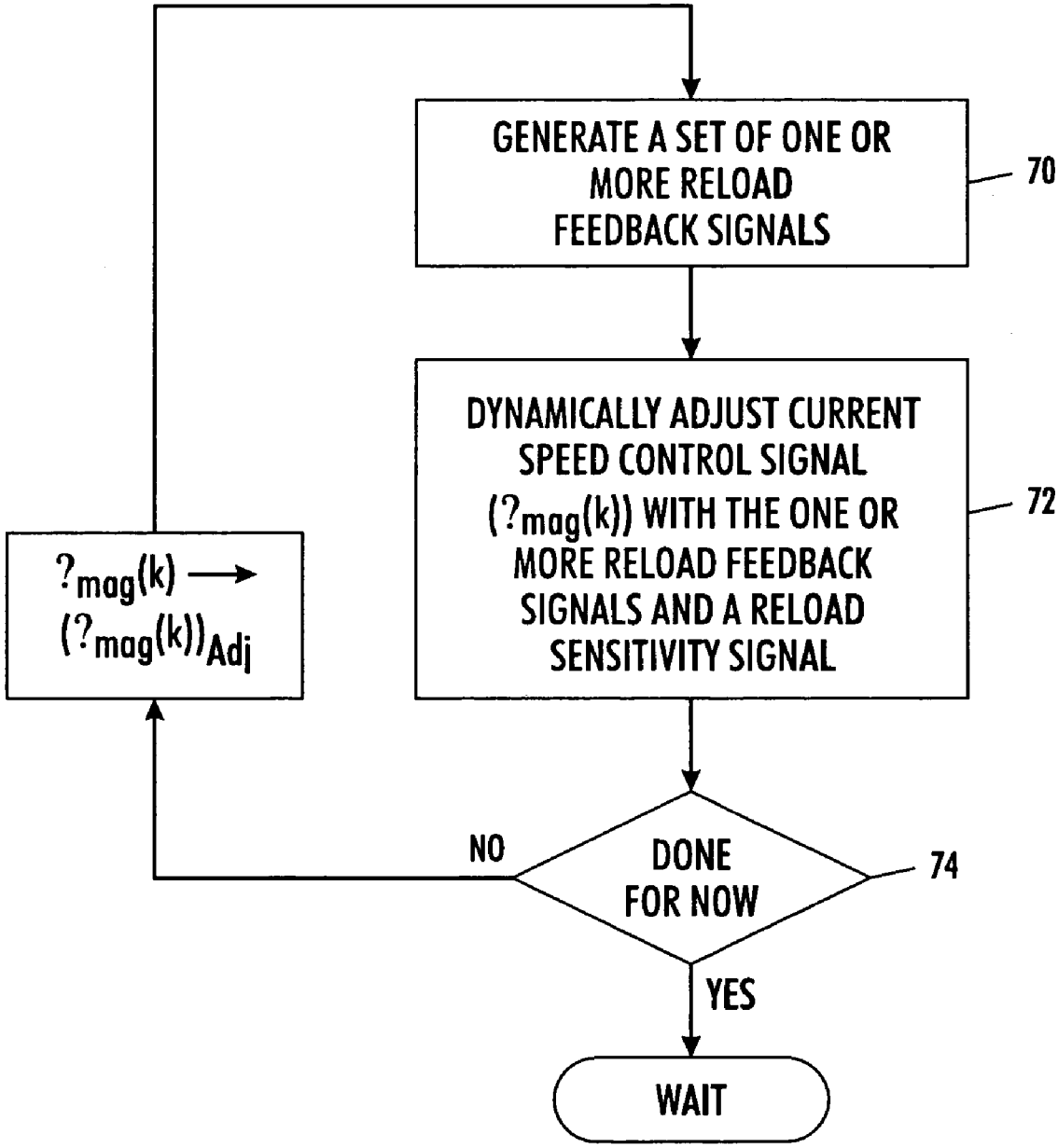
FIG. 6 is a flow diagram illustrating exemplary methodology suitable for use with the control system of FIG. 5.

Referring to FIG. 6, an exemplary methodology for use with the implementation of FIG. 5 is shown. At 70, a set of one or more reload feedback signals is developed. In one example, if more than one feedback signal is used, each one of the multiple feedback signals will be staggered from the prior or future feedback signal by a selected sampling interval. At 72, $\omega_{mag}(k)$ is dynamically adjusted with the algorithm—using $M_{reload}(k)$ and $Y_{reload}(m)$ as inputs. A check is performed at 74 to determine if further adjustment of $M_{reload}(m)$ is desired. Assuming immediate update for feedback of output reload performance is desired, the current adjusted $\omega_{mag}(k)$ (76) is fed back to 70 for repetition of the process.

Depending on the process parameters of the host print engine, the sampling of output reload performance may vary as a function of various factors. For slowly drifting process parameters, it is contemplated that an experiment could be used to assess current reload performance. This experiment might include developing a series of patches (both sources and targets) and varying magnetic roll speed while measuring output mass variations in the target patches (those where reload is expected to be noticed). This sort of experimental approach would not necessitate waste of paper, but would merely require a minimal amount of toner usage. This experiment might be run once a day or before each long job depending on the time constants of the process noises of interest. For example, the effects of carrier aging on reload performance might result in a long time constant effect and such effects on carrier aging could possibly be managed through a simple experiment in which current reload performance would be measured prior to running long print jobs.

For other process noises that affect reload and have faster time constants, it might be desirable to characterize reload performance "on-the-fly" during actual printing of the customer's job. In one contemplated approach, this might be achieved by skipping one or more pitches (not printing pages) while the required patches were printed and measuring the reload for various magnetic roll speeds. Even under this approach, the amount of time in which the host printing system skips pitches would be relatively small compared to the overall time required to print a typical job.

While it is contemplated that the disclosed embodiments can be implemented in situations where process parameters vary rapidly, implementation might, in many situations, be readily obtained with relatively longer time constants which tend to cause longer term drifts in the reload performance of the system. Thus, measurements associated with relatively longer time constants, such as measurements obtained during job setup or measurements obtained relatively infrequently from a customer's print job should suffice in providing the feedback required for the control systems of FIGS. 3 and 5.

Based on the above description, various aspects of the disclosed embodiments should now be apparent:

(1) In one aspect of the disclosed embodiments, the control system might include an image analyzing system operatively associated with an algorithm, the algorithm being used to develop a reload sensitivity signal and accommodating for an input corresponding with a reload performance feedback signal. For instance, an input signal (I(k)), corresponding with input digital image content, might be provided to the image analyzing system, and the reload feedback signal might correspond with a sample of reload defect performance output ($Y_{reload}(m)$). Accordingly, the algorithm would operate in such a manner that the reload sensitivity signal ($M_{reload}(k)$) varies as a function I(k) and $Y_{reload}(m)$.

(2) In another aspect of the disclosed embodiments, the control system might include a magnetic roll speed selector operatively associated with a controller, and the magnetic roll speed selector would be capable of setting the magnetic roll speed as a function of the reload sensitivity signal. In one example, when the reload sensitivity signal is greater than a selected threshold, the magnetic roll speed selector selects a first magnetic roll speed for use by a development process, and when the reload sensitivity signal is less than the threshold, the magnetic roll speed selector selects a second magnetic roll speed for use by the development process. In another example, the reload sensitivity signal is corresponded with a single signal within a pre-selected range of signals.

(3) In yet another aspect of the disclosed embodiments, the reload feedback signal is obtained from a sample of a representative developed image. In one example, the reload defect feedback signal is to be used pursuant to developing a selected print job, and the sample is obtained prior to developing the selected print job.

(4) In yet another aspect of the disclosed embodiments, the image analyzing system transmits the reload sensitivity signal to the controller so that a speed control related signal is formed with both the reload sensitivity signal and a set of one or more reload feedback signals. In one example, this forming of the speed control related signal is performed with an algorithm, the algorithm using both the reload sensitivity signal and the set of one or more reload feedback signals as input information. Additionally, the algorithm may employ an adjustable gain, where adjustments to the adjustable gain can be made with the set of one or more reload feedback signals.

(5) In yet another aspect of the disclosed embodiments, (a) the set of one or more reload feedback signals might comprise a first reload defect feedback signal occurring at a first time and a second reload defect feedback signal occurring at a second time, and (b) the first time is separated from the second time by a selected time interval.

(6) In another aspect of the disclosed embodiments, the magnetic roll speed selector is capable of setting magnetic roll speed as a function of the set of one or more reload defect feedback signals.

It will be appreciated that various ones of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A control system for use with a development process including at least one magnetic roll with a settable speed, the development process outputting a reload performance signal, comprising:

a controller, responsive to a reload sensitivity signal, for controlling the speed of the at least one magnetic roll;

an image analyzing system, communicating with said controller, for transmitting the reload sensitivity signal to said controller;

a reload detection system communicating with an output of the development process, said reload detection system generating a set of one or more reload feedback signals in response to changes in output reload performance of the development process, wherein the reload sensitivity signal is adjusted dynamically with the set of one or more reload feedback signals; and wherein said controller causes the speed of the at least one magnetic roll to be set with the dynamically adjusted reload sensitivity signal.

2. The control system of claim 1, wherein said image analyzing system is operatively associated with an algorithm for developing the reload sensitivity signal, and wherein the algorithm accommodates for an input corresponding with the set of one or more reload feedback signals.

3. The control system of claim 2, in which an input signal (I(k)), corresponding with input digital image content, is provided to said image analyzing system, and in which the set of one or more reload feedback signals corresponds with a sample of reload performance output ($Y_{reload}(m)$), wherein the algorithm operates in such a manner that the reload sensitivity signal ($M_{reload}(k)$) varies as a function I(k) and $Y_{reload}(m)$.

4. The control system of claim 1, further comprising a magnetic roll speed selector operatively associated with said controller, said magnetic roll speed selector being capable of setting the magnetic roll speed as a function of the reload sensitivity signal.

5. The control system of claim 4, wherein when the reload sensitivity signal is greater than a selected threshold, the magnetic roll speed selector selects a first magnetic roll speed for use by the development process, and when the reload sensitivity signal is less than the threshold, the magnetic roll speed selector selects a second magnetic roll speed for use by the development process.

6. The control system of claim 4, wherein the reload sensitivity signal is corresponded with a single signal within a pre-selected range of signals.

7. The control system of claim 1, wherein the set of one or more reload feedback signals is obtained from a sample of a representative developed image.

8. The control system of claim 7, in which the set of one or more reload feedback signals is to be used pursuant to developing a selected print job, wherein the sample is obtained prior to developing the selected print job.

9. The control system of claim 1, in which the set of one or more reload feedback signals comprises a first reload feedback signal occurring at a first time and a second reload feedback signal occurring at a second time, wherein the first time is separated from the second time by a selected time interval.

10. The control system of claim 1, in which the set of one or more reload feedback signals includes at least two reload feedback signals, wherein each one of the at least two reload feedback signals is assigned a weight for use with the algorithm.

11. A control system for use with a development process including at least one magnetic roll with a settable speed, the development process receiving a speed control related signal and outputting a reload performance signal, comprising:

a controller for controlling the speed of the at least one magnetic roll;

a reload detection system communicating with said controller, said reload detection system generating a set of one or more reload feedback signals responsive to changes in output reload performance of the development process; and wherein said controller, responsive to the set of one or more reload feedback signals, dynamically adjusts the speed control related signal for causing the speed of the at least one magnetic roll to be set.

12. The control system of claim 11, further comprising an image analyzing system, said image analyzing system transmitting a reload sensitivity signal to said controller so that the speed control related signal is formed with the reload sensitivity signal and the set of one or more reload feedback signals.

13. The control system of claim 12, wherein the reload sensitivity signal is adjusted dynamically with the set of one or more reload feedback signals.

14. The control system of claim 12, wherein said forming is performed with an algorithm with both the reload sensitivity signal and the set of one or more reload feedback signals as input information for the algorithm.

15. The control system of claim 14, wherein the algorithm employs an adjustable gain, and wherein adjustments to the adjustable gain are made with the set of one or more reload feedback signals.

16. The control system of claim 11, in which the set of one or more reload feedback signals comprises a first reload feedback signal occurring at a first time and a second reload feedback signal occurring at a second time, wherein the first time is separated from the second time by a selected time interval.

17. The control system of claim 11, in which the set of one or more reload feedback signals includes at least two reload feedback signals, wherein each one of the at least two reload feedback signals is assigned a weight for use with the algorithm.

18. The control system of claim 11, further comprising a magnetic roll speed selector operatively associated with said controller, said magnetic roll speed selector being capable of setting magnetic roll speed as a function of the set of one or more reload feedback signals.

19. The control system of claim 11, wherein the set of one or more reload feedback signals is obtained from a sample of a representative developed image.

20. A method for use with a development process including at least one magnetic roll with a settable speed, the development process outputting a reload performance signal, comprising:

providing a reload sensitivity signal;

generating a reload feedback signal in response to changes in output reload performance of the development process;

dynamically adjusting the reload sensitivity signal with the reload feedback signal; and setting the speed of the at least one magnetic roll with the adjusted reload sensitivity signal.

21. The method of claim 20, in which the reload feedback signal corresponds with a sample of reload performance output ($Y_{reload}(m)$), further comprising (a) providing an input signal (I(k)) corresponding with input digital image content, (b) providing an algorithm for forming the reload sensitivity signal ($M_{reload}(k)$), and (c) operating the algorithm in such a manner that the reload sensitivity signal ($M_{reload}(k)$) varies as a function I(k) and $Y_{reload}(m)$.

22. The method of claim 20, wherein said setting includes mapping the reload sensitivity signal to one of at least two magnetic roll speeds.

23. The method of claim 20, in which the reload feedback signal comprises a first reload feedback signal, and in which the first reload feedback signal is part of a set including a first reload feedback signal occurring at a first time and a second reload feedback signal occurring at a second time, further comprising separating the first time from the second time by a selected time interval.

24. The method of claim 23, further comprising assigning a weight to each one of the first and second reload feedback signals.

25. A method for use with a development process including at least one magnetic roll with a settable speed, the development process receiving a speed control related signal and outputting a reload performance signal, comprising:

responsive to detecting changes in output reload performance, generating a set of one or more reload feedback signals;

dynamically adjusting the speed control related signal, with the set of one or more reload feedback signals, to set the speed of the at least one magnetic roll.

26. The method of claim 25, further comprising controlling the speed control related signal with (a) both a reload sensitivity signal and the set of one or more reload feedback signals, and (b) an algorithm having both the reload sensitivity signal and the set of one or more reload feedback signals as input information for the algorithm.

27. The method of claim 25, in which the set of one or more reload feedback signals comprises a first reload feedback signal occurring at a first time and a second reload feedback signal occurring at a second time, further comprising separating the first time from the second time by a selected time interval.

28. The method of claim 25, in which the set of one or more reload feedback signals includes at least two reload feedback signals, further comprising assigning a weight to each one of the at least two reload feedback signals.

* * * * *